United States Patent [19]

Johnson

[11] 4,088,114

[45] May 9, 1978

[54] FIREPLACE HEATER

[76] Inventor: John Johnson, 3695 Hunter St., Glen Avon Heights, Calif. 92509

[21] Appl. No.: 713,888

[22] Filed: Aug. 12, 1976

[51] Int. Cl.[2] ..... F24B 7/00

[52] U.S. Cl. ..... 126/164; 126/121

[58] Field of Search ..... 126/121, 132, 131, 164, 126/165, 122; 237/51

[56] References Cited

U.S. PATENT DOCUMENTS

| | | | |
|---|---|---|---|
| 463,061 | 11/1891 | Lewis | 126/165 |
| 1,313,085 | 8/1919 | Greene | 126/121 |
| 2,052,643 | 9/1936 | Modine | 126/121 |
| 3,911,894 | 10/1975 | Richard, Jr. | 126/121 |
| 3,942,509 | 3/1976 | Sasser | 126/164 X |
| 4,008,703 | 2/1977 | Allgood | 126/121 |
| 4,010,729 | 3/1977 | Egli | 126/121 |

FOREIGN PATENT DOCUMENTS

| | | | |
|---|---|---|---|
| 24,575 of | 1909 | United Kingdom | 126/165 |
| 556,543 | 10/1943 | United Kingdom | 126/121 |

*Primary Examiner*—William F. O'Dea

*Assistant Examiner*—Harold Joyce

*Attorney, Agent, or Firm*—Knobbe, Martens, Olson, Hubbard & Bear

[57] ABSTRACT

The heat of a fireplace is absorbed by the invention and conducted to a desired area or place instead of merely dissipating and escaping up through the chimney. The invention herein is a fireplace heater and comprises an air conductor having a heat absorbing portion and an air passage through the air conductor and air moving means for moving air through the air passage of the air conductor thereby causing ambient air to pass through the heat absorbing portion which greatly increases the temperature of the air resulting in hot air coming out of the exit opening of the air conductor. An air hole in the air conductor faces in the direction of the fire and the size of the air hole is controlled by a valve. Since air is being moved through the air conductor by the air moving means the effect of the air hole is to fan the fire and give the fire additional oxygen resulting in a hotter fire and a much more easily started fire. The invention is adaptable to various accessories so that various items can be heated or dried such as food, liquids or clothes.

7 Claims, 8 Drawing Figures

FIREPLACE HEATER

BACKGROUND OF THE INVENTION

In the typical fireplace most of the heat rises up and escapes through the chimney and relatively very little heat enters the room. The products of combustion are in part poisonous and are virtually impossible to separate from the heated air. Thus, safety factors dictate that the heated air be diverted up to the chimney with the products of combustion. Typical existing fireplaces cannot be safely modified to improve and increase the amount of usable heat unless the fireplace is torn down and reconstructed.

Typical existing fireplace grates do not allow sufficient amounts of oxygen to reach the item to be burned, resulting in extreme difficulty in starting the fire and a tendency for the fire to go out easily or to suffocate from its own ashes. The present invention solves these problems.

The typical fireplace is very inefficient in producing usable heat and wastes fuel at a time when fuel conservation is to be encouraged. Few fireplaces are capable of heating an entire house. The present invention can provide this capability. Fireplaces do not have any control means over the burn rate or the heat produced such as the present invention provides. Most fireplaces require more than one log in order to maintain a fire. The present invention allows a fireplace to function with just one log. A fireplace without the present invention cannot be safely or easily used to heat or dry various items such as food, liquids, coffee pots, or clothes, to name a few.

SUMMARY OF THE INVENTION

The present invention relates to a fireplace heater wherein a room, environment or thing can be heated by circulating air through a fireplace and directing the heated air to the room, environment or thing to be heated. One object of the invention is to improve the heating efficiency of a fireplace and to increase the usable heat of the fireplace and decrease loss of heat through the chimney. Another object of the invention is to provide a fireplace heater that can be adapted to existing fireplaces. Another object of the invention is to provide a fireplace heater that is capable of controlling the heat and burn rate of the fire in a fireplace and to make it relatively easy to start the fire and to make the fireplace capable of maintaining a fire with one log. Another object of the invention is to provide capability of heating various items such as food, liquids, coffee pots, and clothes.

The present invention is a fireplace heater comprising an air conductor having an internal wall and an entrance opening and an exit opening and a heat absorbing portion between the entrance opening and the exit opening and an air passage through the air conductor from the entrance opening to the exit opening, the air passage enclosed by the internal wall; and air moving means for moving air through the air passage of the air conductor. In a preferred embodiment the air conductor has an external surface and an air hole to the air passage between the internal wall and external surface of the air conductor and a valve is coupled to the air hole.

In another embodiment of the invention the air conductor has the shape of a grate and a plurality of supports extending therefrom and a log retainer coupled to the air conductor. In another preferred embodiment of the invention, the air conductor has a first heat absorbing portion and a second heat absorbing portion and the air passage of the air conductor extends from the entrance opening through the absorbing portions then to the exit opening. It is further preferred that the air passage of the air conductor comprise a first air passage through the first heat absorbing portion and a second air passage through the second heat absorbing passage. Additional heat absorbing capability is provided where the air conductor has a third heat absorbing portion situated above the first and second heat absorbing portions and a fourth heat absorbing portion is situated above the third heat absorbing portion.

In another embodiment of the invention the air conductor has a base absorbing portion having a front side and a back side wherein the entrance opening is on the front side and the exit opening is on, the back side wherein the air conductor has a cross absorbing portion connected at its ends by a sixth and fifth absorbing portions, the absorbing portions situated so that the base absorbing portion has a rectangular shape, and the exit opening is catercorner to the entrance opening.

Additional variations can be added to the invention such as providing a fin on the heat absorbing portion, an exit valve coupled to the exit opening, and coupling the entrance opening to a source of fresh air.

The fireplace heater can also be described as a fireplace heater comprising a heat absorbing leg having an entrance opening and an exit opening and a passage therein from the entrance opening through the exit opening. It is a preferred embodiment that the heat absorbing leg have an internal wall and an external surface and an air hole to the passage between the internal wall and external surface and that a valve is coupled to the air hole. It is also preferred that the fireplace heater comprise a first heat absorbing leg and a second heat absorbing leg and the passage extend from the entrance opening through the heat absorbing legs then to the exit opening.

DETAILED DESCRIPTION

Reference is now made to the accompanying drawings for a better understanding of the invention, wherein all the parts are numbered and directions are identified by letters.

Figure 1:
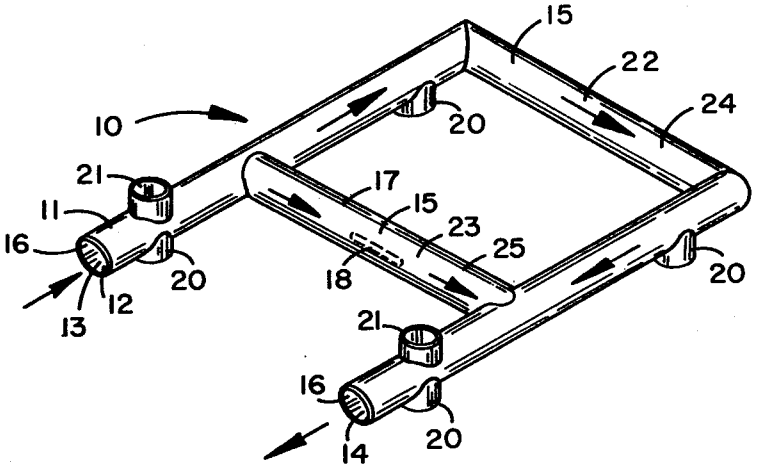
FIG. 1 is a top perspective view of the embodiment employing a first heat absorbing portion, second heat absorbing portion, air hole, log retainer and supports.

In the embodiment shown in FIG. 1 a fireplace heater 10 is indicated generally comprising an air conductor 11 having an internal wall 12 and an entrance opening 13 and an exit opening 14 and a heat absorbing portion 15 between the entrance opening 13 and the exit opening 14 and an air passage 16 through the air conductor 11 from the entrance opening 13 to the exit opening 14, the air passage 16 enclosed by the internal wall 12. The air moving means for moving air through the air passage 16 of the air conductor 11 is not shown. FIG. 1 illustrates the embodiment employing an air conductor 11 having an external surface 17 and an air hole 18 to the air passage 16 between the internal wall 12 and external surface 17 of the air conductor 11. FIG. 1 also illustrates an embodiment wherein the air conductor 11 has a first heat absorbing portion 22 and a second heat absorbing portion 23 and the air passage 16 of the air conductor 11 extends from the entrance opening 16 through the absorbing portions 15 then to the exit opening 14. FIG. 1 also illustrates the embodiment featuring the air conductor 11 having the shape of a grate and a plurality of supports 20 extending therefrom and a log retainer 21 coupled to the air conductor 11. FIG. 1 also illustrates the air passage 16 of the air conductor 11 comprising a first air passage 24 through the first heat absorbing portion 22 and a second air passage 25 through the second heat absorbing portion 23. Arrows indicate the direction of air flow starting at the entrance opening 13 through the first heat absorbing portion 22 and second heat absorbing portion 23 and out the exit opening 14. The air hole 18 shown in FIG. 1 is actually on the back side of the second heat absorbing portion 23 and is thus illustrated by dashed lines. The air conductor 11 shown in FIG. 1 has the shape of a grate and therefore is capable of supporting logs, not shown.

Figure 2:
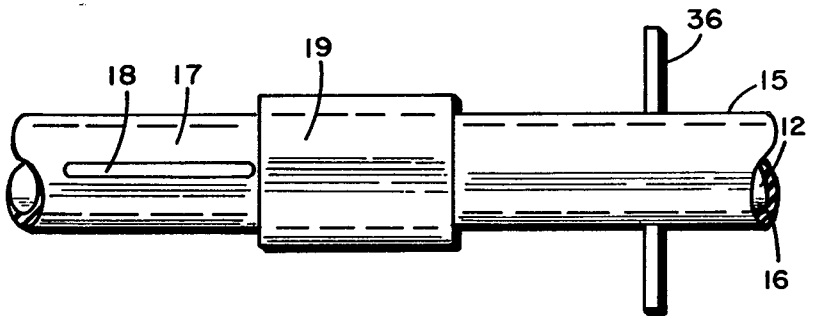
FIG. 2 is a fragmentary view of the air conductor illustrating the air hole and the valve coupled to the air hole and a fin.

FIG. 2 illustrates the air hole 18 and a valve 19 coupled to the air hole 18 and is a back view of the air conductor 11 shown in FIG. 1. The air hole 18 may be positioned on the air conductor 11 at any desired position, however, a preferred position is that pictured in FIG. 1 and it is preferred that the air hole face towards the log, not shown, and fire in the fireplace, not shown. The air hole 18 may have a variety of shapes and sizes. The valve 19 shown in FIG. 2 is a sliding type valve having the same general shape as the external surface of the air conductor 17. The valve 19 is slidably coupled to the air conductor 11. Valves of a variety of size and shape would suffice depending on the shape and size of the air hole 18. FIG. 2 also illustrates the interior wall 12 of the air conductor 11 and the air passage 16 enclosed by the interior wall 12 of the air conductor 11. FIG. 2 also shows the heat absorbing portion 15 having a fin 36 extending therefrom. The fin 36 would assist in absorbing heat and may be of a variety of sizes, shapes and materials. It would be preferred that the fin 36 be made from a material that would easily conduct heat such as a metal.

The air moving means 45 is coupled to the entrance opening 13. A squirrel cage blower is a preferred type of air moving means. An electric fan could also be the air moving means. It is preferred that the entrance opening 13 have a 2-inch diameter with a ⅛-inch wall so that commercially available squirrel cage blowers can be directly connected to the entrance opening 13.

The embodiment shown in FIG. 1 has the disadvantage of having the heat absorbing portion 15 below the fire in the fireplace, not shown. The supports 20 could be of sufficient length to raise the fireplace heater 10 or the heat absorbing portion 15 above the fire, however, the fireplace heater 10 could not perform the added function of a grate if it was raised above the fire since the logs, not shown, by necessity must be actually in the fire. The invention does contemplate, however, that the heat absorbing portion could be extended above the fire.

Figure 3:
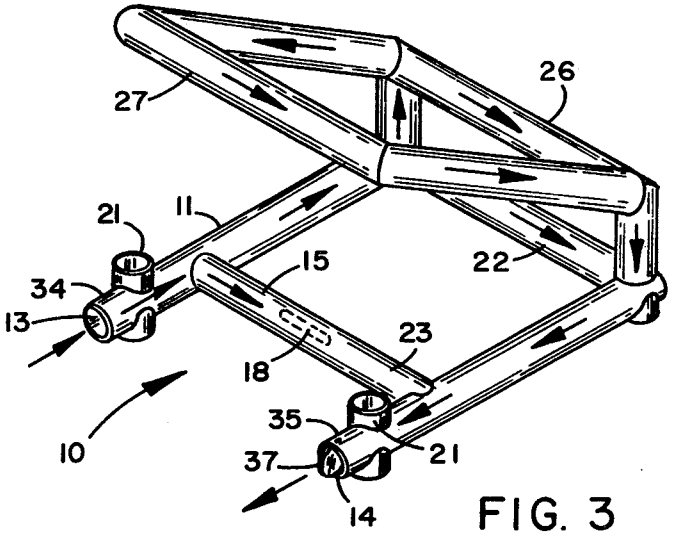
FIG. 3 is a top perspective view of the fireplace heater of the embodiment employing a third heat absorbing portion situated above the first and second heat absorbing portions and a fourth heat absorbing portion situated above the third heat absorbing portion.
Figure 4:
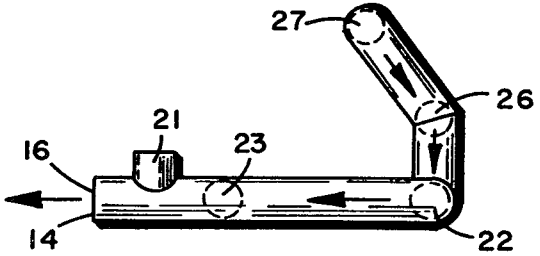
FIG. 4 is a side view of the fireplace heater of the embodiment shown in FIG. 3.

In the embodiment shown in FIG. 3 the air conductor 11 has a third heat absorbing portion 26 situated above the first and second heat absorbing portions and has a fourth heat absorbing portion 27 situated above the third heat absorbing portion 26. Also shown is an exit valve 37 coupled to the exit opening 14 thereby permitting the control of the amount of heat from the exit opening 14. Also shown in FIG. 3 is an entrance conductor portion 34 between the entrance opening 13 and the absorbing portions 15 of the air conductor 11 and an exit conductor portion 35 between the exit opening 14 and the absorbing portions 15 of the air conductor 11. An embodiment having an entrance conductor portion 34 and an exit conductor portion 35 permits the entrance opening 13 and exit opening 14 to extend out into a room without the hazard of undue temperatures on their surfaces capable of inflicting a burn on a person. The embodiment in FIG. 3 has all of the advantages of the embodiment shown in FIG. 1 and provides the additional advantage of having a third heat absorbing portion 26 and fourth heat absorbing portion 27 extending into or above the fire thereby absorbing additional heat not possible by heat absorbing portions placed below the fire. The air conduction system of the embodiment shown in FIG. 3, as illustrated by the arrows therein, in such that no opposing air flow forces are created. Therefore, the possibility of stagnation is eliminated. FIG. 4 is a side view of the embodiment shown in FIG. 3 and the first heat absorbing portion 22 and second heat absorbing portion 23 and third heat absorbing portion 26 and fourth heat absorbing portion 27 are shown by dashed circular lines for reference.

Figure 6:
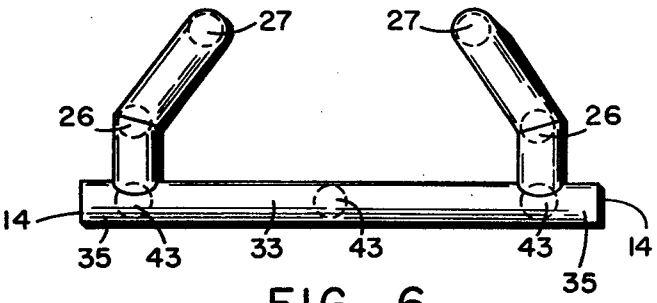
FIG. 6 is a side view of a fireplace heater for a double fireplace of the embodiment shown in FIG. 5.
Figure 5:
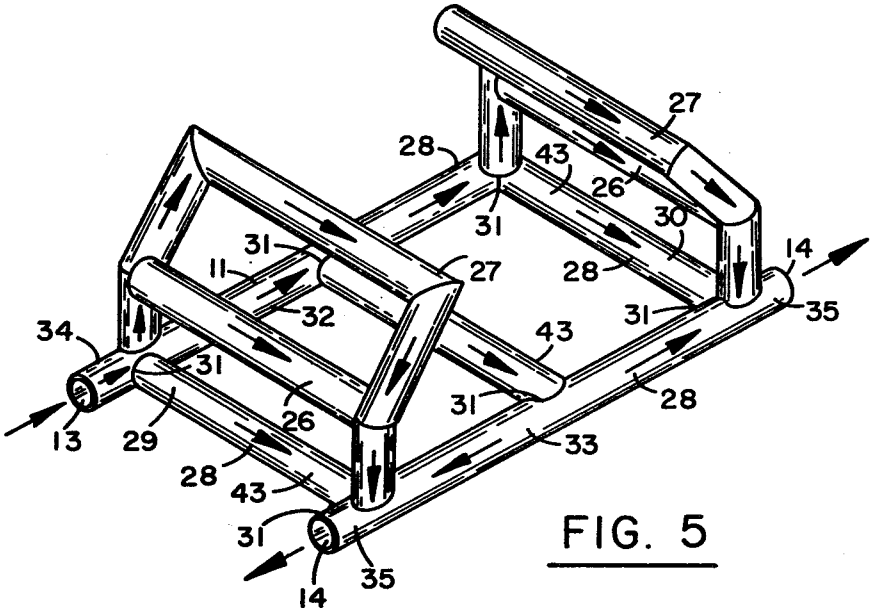
FIG. 5 is a top perspective view of a fireplace heater for a double fireplace of the embodiment employing a base absorbing portion, three parallel absorbing portions connected at their ends by a sixth and fifth absorbing portions so that the base absorbing portion has a rectangular shape wherein the exit opening is catercorner to the entrance opening.

The embodiment shown in FIG. 5 is designed for a double fireplace so that heated air can be discharged into two separate rooms. This embodiment is similar to the embodiment shown in FIG. 3 and further comprises an air conductor 11 that has a base absorbing portion 28 having a front side 29 and back side 30 wherein the entrance opening 13 is on the front side 29 and the exit opening 14 is on the back side 30. In this embodiment it is further preferred that the air conductor 11 have a cross absorbing portion 43 connected at its ends 31 by a sixth 32 and fifth 33 absorbing portions, the absorbing portions situated so that the base absorbing portion 28 has a rectangular shape, and the exit opening 14 is catercorner to the entrance opening 13. FIG. 5 illustrates an embodiment wherein the air conductor 11 has three cross absorbing portions 43 substantially parallel to one another. An advantage to having three cross absorbing portions 43 as shown in FIG. 5 is that the cross absorbing portions 43 will provide a grate for logs, not shown, thereby keeping the logs, not shown, above the floor of the fireplace, not shown, thereby permitting additional oxygen to reach the logs and fire, not shown. Improved air circulation also results by having three cross absorbing portions substantially parallel to one another and perpendicular to the sixth 32 and fifth 33 heat absorbing portions. A substantially right angle intersection of various parts of the air conductor 11 result in less friction of the air with the air conductor 11. Substantially equal air pressure throughout the air conductor 11 is accomplished by having the exit opening 14 that is catercorner to the entrance opening 13 and can be further equalized by having an exit valve, not shown in FIG. 5, coupled to the exit opening 14 on the front side 29 of the base absorbing portion 28. As shown in FIG. 5 the base absorbing portion 28 comprises all of the lower portions of the air conductor 11. FIG. 6 is a side view of the embodiment shown in FIG. 5 and the three cross absorbing portions 43, two third heat absorbing portions 26 and two fourth heat absorbing portions 27 are shown by dashed circular lines for reference.

Figure 7:
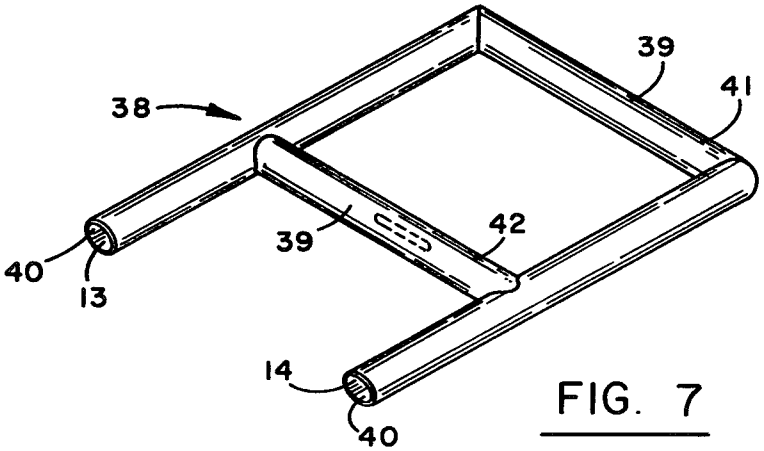
FIG. 7 is a top perspective view of a fireplace heater comprising a first heat absorbing leg and a second heat absorbing leg and a air hole.

The invention may also exist without the benefit of air moving means as shown in FIG. 7. In the embodiment shown in FIG. 7 a fireplace heater 38 is indicated generally comprising a heat absorbing leg 39 having an entrance opening 13 and an exit opening 14 and a passage 40 therein from the entrance opening 13 to the exit opening 14. The embodiment shown in FIG. 7 further illustrates a fireplace heater 38 comprising a first heat absorbing leg 41 and a second heat absorbing leg 42 and a passage 40 extending from the entrance opening 13 through the heat absorbing legs 39 then to the exit opening 14. Although not illustrated in detail, it is readily understandable that the fireplace heater 38 can exist in the embodiment heretofore described with respect to the fireplace heater 10 shown in FIGS. 1 through 6 and thus the heat absorbing leg 39 may have an internal wall 12 and an external surface 17 and an air hole 18 to the passage 40 between the internal wall 12 and external surface 17 similar to that shown in FIGS. 1 through 6. Similar to the embodiment shown in FIG. 2 a valve 19 may be coupled to the air hole 18. Likewise the fireplace heater 38 may have the shape of a grate and further comprise a plurality of supports 20 extending therefrom and a log retainer 21 similar to that shown in FIG. 1.

Figure 8:
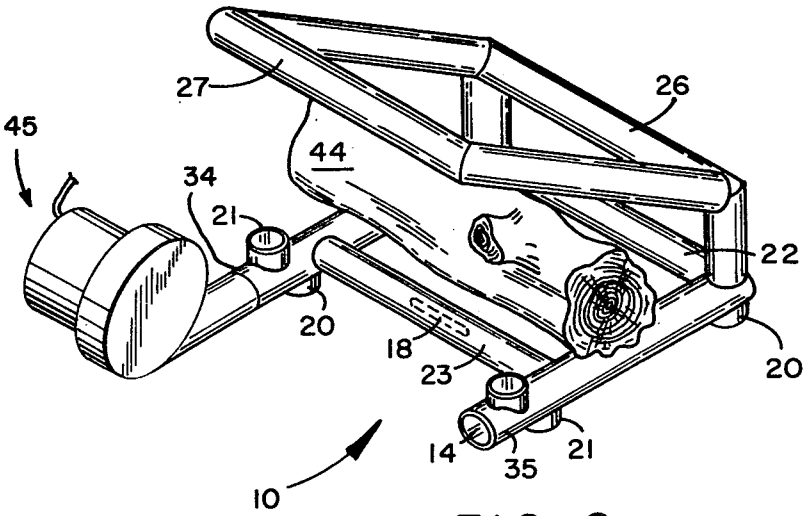
FIG. 8 is a top perspective view of a fireplace heater of the embodiment shown in FIG. 3 and further illustrating a log positioned on the fireplace heater.

Finally the embodiment shown in FIG. 8 illustrates a log 44 situated in an embodiment similar to that shown in FIG. 3 and air moving means 45.

The invention herein may be made of any material that is capable of standing extremely high temperatures and the stress and strain of being subjected to the heat and flames of a fire. All pipe seamless steel having a 2 inch diameter and ⅛ inch wall would be suitable. The pipe may be cut to the desired length and shaped and welded together. It is preferred that all turns and intersections be square or perpendicular in order to minimize air friction within the system. The air moving means may be a blower, fan or squirrel cage blower. The squirrel cage blower is a preferred embodiment. A squirrel cage blower can be directly fastened to the entrance opening 13 or a flex line, not shown, can be adapted to couple the air moving means to the entrance opening 13. A flexible coupling device between the air moving means and the entrance opening 13 would enable the use of fresh air from outside to be used as a source of air. Another alternative would be to connect a pipe to the outside of the home and run it into the home to the intake of the squirrel cage blower thus providing a fresh air supply.

The invention herein is uniquely suitable to efficiently heat a room from a normal fireplace. In addition, the hot air coming from the exit opening 14 can be utilized to heat various items such as a oven for raising bread or baking potatoes or for merely keeping food warm. The hot air exiting the invention could also be used to dry clothes, hair, heat coffee or any other item requiring heat or for which it is desired to heat.

The invention herein can also function without the need of air moving means, however, the efficiency of the fireplace heater would be greatly diminished without having some means of forcing air through the system.

The temperature of the air coming from the exit opening 14 exceeds 250° F. Thus, if the hot air is to be moved to another area, a heat resistant hose having a material that resists the effect of the heat such as an asbestos hose should be employed to avoid the danger of creating a fire hazard.

The air hole 18 should face toward the fire or the log in order to provide oxygen directly to the area of combustion and a preferred embodiment is that the air hole be approximately 1/16 of an inch in height and have a length of an inch or more.

Through various accessories, the invention herein can be used to heat an entire house effectively and efficiently. Means to conduct the exit opening 14 to the heating ducts of one's home could accomplish this.

It is to be understood that the invention is not limited to the exact details of construction, operation, or exact materials or embodiment shown and described, as obvious modifications and equivalents will be apparent to one skilled in the art, and the invention is therefore to be limited only by the scope of the appended claims.

I claim:

1. A fireplace heater, comprising:

first and second heat absorbing air conduits each having an inlet and an outlet, said inlet of said first conduit receiving air into said fireplace heater and said outlet of said second conduit expelling air from said fireplace heater;

a third heat absorbing air conduit interconnecting said first and second conduits, having an inlet in communication with said first conduit near the inlet of said first conduit and an outlet in communication with said second conduit near the outlet of said second conduit;

a fourth heat absorbing air conduit interconnecting said first and second conduits, having an inlet in communication with said first conduit essentially at the outlet of said first conduit and an outlet in communication with said second conduit essentially at the inlet of said second conduit;

said first, second, third and fourth heat absorbing air conduits defining generally a fireplace grate;

first and second upright heat absorbing air conduits each having an inlet and outlet, said inlet of said first upright conduit in communication with said fireplace grate essentially at the juncture of said first and fourth conduits and the outlets of said second upright conduit in communication with said fireplace grate near the juncture of said second and fourth conduits;

first and second upper heat absorbing air conduits each having an inlet and an outlet, said inlet of said first upper conduit and said outlet of said second upper conduit in respective communication with said first and second upright conduits essentially at the outlet of said first upright conduit and the inlet of said second upright conduit;

third and fourth upper heat absorbing air conduits interconnecting said first and second upper conduits and each having an inlet and an outlet, said inlet and outlet of said third upper conduit in respective communication with said first and second upper conduits essentially at the outlet of said first upper conduit and the inlet of said second upper conduit respectively, said inlet and outlet of said fourth upper conduit in respective communication with said first and second upper conduits essentially at said inlet of said first upper conduit and said outlet of said second upper conduit;

said first, second, third and fourth upper heat absorbing air conduits defining a plane located generally above said fireplace grate and supported by said first and second upright conduits;

air moving means in communication with said inlet of said first heat absorbing air conduit for the circulation of air through said fireplace heater.

2. A fireplace heater as defined in claim 1 wherein said fireplace grate is supported by a plurality of supports attached to said grate and additionally comprises means for fireplace fuel retention.

3. The fireplace heater as defined in claim 1, additionally comprising:

air vent and valve means coupled to said third heat absorbing air conduit to allow the passage of air from said conduit to a fire;

fin means attached to each said heat absorbing air conduit; and an exit valve coupled to said outlet of said second heat absorbing air conduit.

4. A fireplace heater as defined in claim 1 wherein the plane formed by said first, second, third and fourth upper heat absorbing air conduits intersects at an angle the plane formed by said fireplace grate.

5. The heater of claim 1 including vent means in one of said conduits to allow passage of air from said one conduit to a fire in said fireplace.

6. A fireplace heater, comprising:

a first plurality of air conduits forming a fireplace grate including a pair of side conduits to extend along the sides of a fireplace, each of said conduits having at least one inlet and at least one outlet;

a second plurality of air conduits disposed over said fireplace grate, each of said conduits having at least one inlet and at least one outlet;

air conduit means connecting said first and second plurality of air conduits to form a heater system, each member of said air conduit means having at least one inlet and at least one outlet;

an inlet to one of said side conduits forming an entrance to said heater system and an outlet from the other of said pair of side conduits forming an exit from said heater system;

each of the remainder of said inlets being connected to the outlet of another conduit, and each of the remainder of said outlets being connected to the inlet of another conduit; and air moving means in communication with said entrance of said heater system for the circulation of air from said entrance through each of said conduits to the exit of said heater system, without counterflow.

7. The heater of claim 6 including vent means in one of said conduits to allow passage of air from said one conduit to a fire in said fireplace.

* * * * *